US005915541A

United States Patent [19]

Beltrani

[11] Patent Number: 5,915,541

[45] Date of Patent: Jun. 29, 1999

[54] SWIMMING OR DIVING GOGGLES

[75] Inventor: Giovanni Battista Beltrani, Genoa, Italy

[73] Assignee: Technisub S.p.A., Genova, Italy

[21] Appl. No.: 08/910,750

[22] Filed: Aug. 13, 1997

[30] Foreign Application Priority Data

Aug. 13, 1996 [IT] Italy ..... TO96A0698

[51] Int. Cl.[6] ..... A61F 9/02

[52] U.S. Cl. ..... 2/430; 2/431

[58] Field of Search ..... 2/428, 429, 430, 2/431, 432, 452; 351/43; 427/164

[56] References Cited

U.S. PATENT DOCUMENTS

| | | | |
|---|---|---|---|
| 3,027,562 | 7/1962 | Widenor . | |
| 4,127,682 | 11/1978 | Laurin | 427/164 |
| 4,607,398 | 8/1986 | Faulconer . | |
| 5,523,804 | 6/1996 | Nolan . | |
| 5,564,132 | 10/1996 | Kuo . | |
| 5,596,771 | 1/1997 | Hsu et al. | 2/428 |
| 5,657,493 | 8/1997 | Ferrero et al. | 2/428 |
| 5,668,618 | 9/1997 | Simioni | 2/432 X |

FOREIGN PATENT DOCUMENTS

| | | |
|---|---|---|
| 906927 | 2/1946 | France . |
| 2160190 | 6/1973 | France . |
| 2431302 | 2/1980 | France . |
| 4218349 | 12/1993 | Germany . |
| 1431954 | 4/1976 | United Kingdom . |

*Primary Examiner*—Peter Nerbun

*Attorney, Agent, or Firm*—Sughrue, Mion, Zinn, Macpeak & Sea, PLLC

[57] ABSTRACT

Swimming or diving goggles comprising a one- or two-curved-lens system having a progressive cornerless curvature of cylindrical type with vertical axes and variable radius, without curvature in the vertical plane and described by a peculiar geometrical law, according to which the front portion located in front of the user's eyes has a curvature radius not less than 130 mm, and the two lateral portions have a lower curvature radius, anyway not less than 25 mm. The distance of the lens or lenses from the user's face is extremely reduced and such that two rays coming out from the eyes and lying on the horizontal plane intersect the lens or lenses at two point such that the perpendiculars to the inner surface of the lens or lenses at those two points form an angle not greater than 30° therebetween.

16 Claims, 4 Drawing Sheets

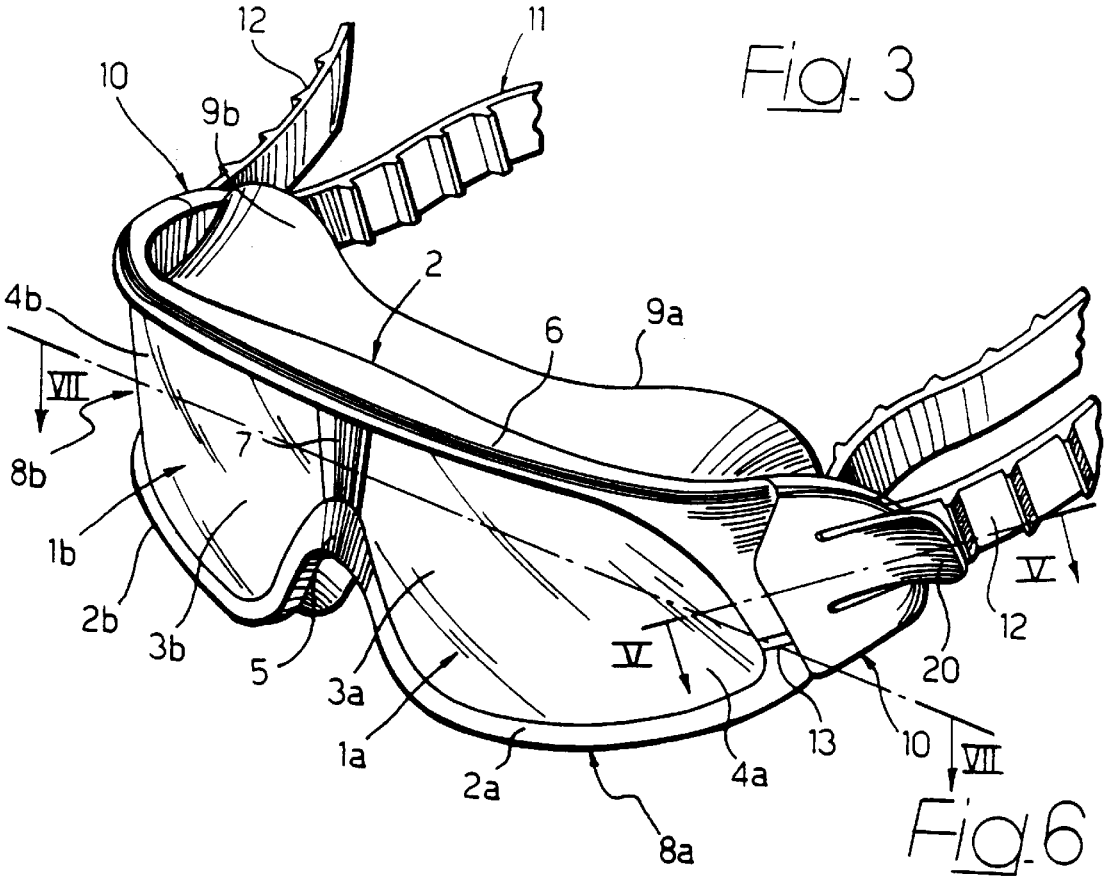
Fig. 3
Fig. 6
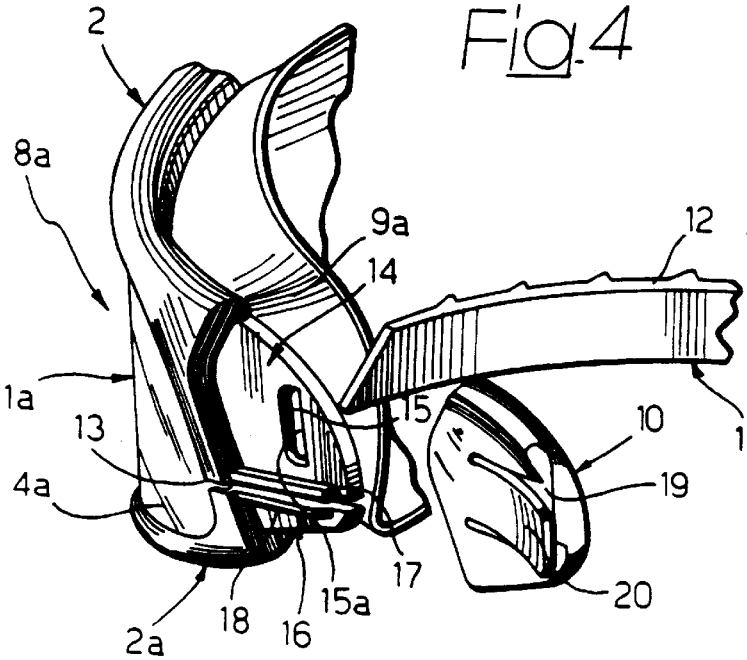
Fig. 4
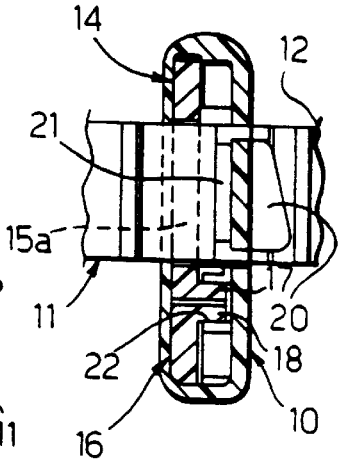

SWIMMING OR DIVING GOGGLES

BACKGROUND OF THE INVENTION

The present invention is related to goggles for swimmers or divers.

For a more complete understanding of the invention, it is convenient to state beforehand a brief explanation in connection with the background art in the general field of underwater vision.

It is well known that the main problem to be faced in underwater vision is related to the fact that a non planar lens, which in the air would not cause visible or remarkable distortions, underwater is instead constituting a dioptric surface when separating water from air. It is to be pointed out that, in the present description and in the following claims, the term "lens" is intended to designate precisely the transparent optical diaphragm which in use is separating the water environment from the air volume comprised between such diaphragm and the surface of the user's face surrounding his eyes. Since water and air have quite different indexes of refraction, a curvature or a prismatic configuration of the lens hugely affects the refraction problems.

The general state of the art related to masks and goggles for swimmers or divers is diagrammatically shown in FIGS. 9 through 15, which are top plan and partially sectioned views of different conventional solutions.

FIG. 9 depicts a first known arrangement, normally employed in the case of diver masks, according to which a planar lens is provided, which can be formed by a single or by two symmetrical pieces, mutually kept co-planar by a rigid frame structure. This is the most common arrangement, even due to technological reasons deriving from easy manufacturing of planar glass lenses. In use, vision is without defects, but the visual field is necessarily limited, i.e. is laterally null. Moreover, hydrodynamic encumbrance is relevant.

FIG. 10 shows a configuration including two distinct non co-planar lenses: in this case the hydrodynamic encumbrance is reduced, but vision is quite poor. Actually, a same object seen in the water by both eyes originates two different images, which makes the user feel queasy.

FIG. 11 shows another known arrangement with a planar front lens and two lateral angled planar lenses. In this case the visual field is extended frontally and even laterally, but the image is broken into three pieces owing to the presence of two "blind" intermediate fields, corresponding to the angles formed between the central lens and two lateral lenses. The visual effect is accordingly very annoying, even in consideration of the fact that water refraction further magnifies the above two blind fields. Even in this case the user is subjected to nausea and confusion due to fact that the watched object somehow disappears and reappears.

FIGS. 12 and 13 show two known arrangements according to which the lens is entirely or partially curved, but with an erroneous curvature or with a position of the lens too much spaced ahead of the face and thus of the user's eyes. With the solution according to FIG. 12, in which the lens is entirely curved with a constant curvature radius, the image is doubled in correspondance of the central area of the lens (same defect as in the case of FIG. 10), owing to a too small curvature radius in that area. With the solution according to FIG. 13, wherein only the lateral portions of the lens are curved while the central front portion is planar, vision through the lateral areas produces out of focus and deformed images.

The situation does not improve with solutions, similar to that depicted in FIG. 12 or in FIG. 13, in which however the lens profile is curved not only in the horizontal plane, but also in the vertical plane, for instance such as disclosed and illustrated in German patent application DE-A-4218349. As a matter of fact such a substantially spherical curvature generates additional important visual defects: firstly, the central substantially planar area of the lens—which would provide a vision practically deprived of defects—is indeed too reduced, since delimited, not only at the right and left sides but also above and below the line joining the two optical centers of the lens, by a wide toric area originating important optical imperfections. Secondly, hugely deformed and out-of-focus images come from the two upper and lower curved areas, which hit portions of the user's eyes which are perfectly capable of accurate vision (the lower portion is the one which is normally employed when reading, while the upper portion is often used for far vision), and thus perfectly suitable to detect even the slightest optical defect, which again involves annoyance and nausea for the user.

In this specific field of goggles for swimming or diving, the currently available known solutions substantially correspond to those depicted in FIG. 10, already disclosed in the above, and in FIGS. 14 and 15. In the case of FIG. 14 two separate lenses are provided, having respective planar front surfaces and respective planar or cylindrical lateral surfaces. This solution involved the same defects as the arrangement previously disclosed with reference to FIG. 11, with the further inconveniences consisting of image doubling at the central separation area between the two lenses, when watching close objects.

In the case of FIG. 15 two distinct and separate lenses are also provided, each having a front portion merging with a lateral curved portion. This arrangement corresponds to that disclosed and illustrated in British patent GB-1431954, according to which the two lenses are part of two respective eyepieces centrally connected by a flexible bridging strap, whereby their mutual positioning is not rigid. Moreover, according to the above prior document the lenses have a curvature not only in the horizontal plane, but also in the vertical plane, according to a crowned configuration such that the respective central areas placed in use in front of the user's eyes are remarkably advanced, i.e. quite spaced ahead of the eyes themselves. This arrangement involves the sum of vision defects and inconveniences previously disclosed with reference to the solutions shown in FIGS. 10 and 13.

In addition to the above inconveniences from the optical point of view, the goggles for swimmers or divers according to the prior art are further affected by the following additional problems.

As far as wearing on the user's face is concerned, while in the case of the masks the bearing area thereof has a continuous annular shape so as to include the user's nose and to rests above the user's upper lip, in the case of goggles having two distinct eyepieces, whereby the user's nose is not enclosed, bearing on the user's face takes place through respective annular contact members in correspondence of the eye orbits. In order to ensure watertightness of these annular contact members, the two eyepieces are made mutually orientable in connection both to center-to-center and inclination thereof, which produces as a consequence important visual defects.

In addition to the above, a remarkable lack of comfort and a certain physical annoyance are experienced by the user. On the other hand, the presently existing goggles are suitable neither for plunging nor for fast swimming: protrusion of the two eyepieces forwardly and laterally of the user's face actually make these goggles hugely dragging and also unstable, since impact thereof with the water has a tendency to displace them from the correct position relative to the user's face. Moreover since the lenses of the conventional goggles are normally made of glass having a thickness generally comprised between three and five millimeters, these known goggles are equally unsuitable to be employed either for fast swimming, or in stream or rough water or for plunging, owing to their massive structure and relatively remarkable weight. Brittleness of glass, even if tempered, renders these goggles dangerous for instance even upon start plunging in swimming competition.

In the known swimming goggles wherein positioning of the lenses relative to the theoretical one is extremely variable owing to the absence of a mutual rigid connection therebetween, additional visual defects are originated consisting of image doubling and deformation, with a consequent nausea effect for the user.

A further problem is related to adjustment of the goggles retainer strap behind the user's head. Differently from the case of modern diving mask, in which sophisticated automatic buckle systems (such as those disclosed in U.S. Pat. No. 4,607,398 and in Italian Utility Model IT-U-167555) enable adjustment of the retainer strap by a simple operation with the mask on, not even one example of swimming goggles exists which does not instead require complex operations, which can not be performed while the goggles are worn by the user. This is due to the fact that no goggles designer has ever conceived an automatic buckle which is sufficiently compact to be housed within the small goggles size.

SUMMARY OF THE INVENTION

The object of the present invention is to provide a global solution to solve all the above referenced problems and inconveniences related to the prior art.

A particular object of the invention is to provide swimming or diving goggles adapted to ensure in use a totally panoramic vision substantially over 180°, deprived of obstacles and without important optical disturbances.

A further particular object of the invention is to provide swimming or diving goggles having an extremely reduced hydrodynamic drag and, as a consequence an enhanced stability on the user's face.

Still another particular object of the invention is to provide goggles ensuring watertight and comfortable bearing onto the user's face over the largest face conformation range.

A further particular object of the invention is to provide swimming or diving goggles having a drastically reduced weight.

Another particular object of the invention is to provide swimming or diving goggles enabling easy adjustment of the retainer strap around the user's head, even while the goggles are worn.

According to the invention, these objects are achieved by swimming or diving goggles comprising a pair of side-by-side symmetrical lenses, contact means sealingly connected to said lenses and in use to be applied in a watertight fashion onto the face surface surrounding the eyes of a user, connecting means between said lenses, retainer means of the goggles behind the user's head, wherein each lens has, with reference to a respective user's eye, a front portion and an outer lateral curved portion smoothly merging with each other without corners, and wherein each lens is shaped according to a cylindrical surface having rectilinear vertical generating lines and progressively variable curvature radius, much greater in correspondance of said front portion and smaller in correspondance of said lateral portion, said connecting means are substantially rigid and substantially shaped and arranged according to the same cylindrical surfaces of the respective lenses and said contact means are secured to said lenses through said connecting means, whereby in use said lenses are placed in close proximity of the face surface surrounding the eyes of the user.

BRIEF DESCRIPTION OF THE DRAWINGS

The features and advantages of the invention will become apparent through the following detailed description, with reference to the accompanying drawings purely provided by way of non limiting example, in which:

FIG. 3 is a perspective view showing one example of a preferred embodiment of the goggles according to the invention, FIG. 4 is a partial and partially exploded lateral elevational view of FIG. 3, FIG. 6 is a vertically sectioned view along VI—VI of FIG. 5.

DETAILED DESCRIPTION OF THE INVENTION

It is to be preliminary pointed out that in the foregoing and in the following the terms "horizontal" and "vertical", "upper" and "lower" and the like are intended to be referred, for convenience of description, to the worn condition of the goggles according to the invention on the face of an upstanding user.

In general terms, novelty and inventiveness of the goggles according to the invention consist, from a conceptual point of view, of a particular geometry capable to provide a practically non deformed vision in the areas at which the human eye is capable of seeing perfectly (front, up, down), while consigning to the two lateral extremes the less perfect vision area, through a proper selection of the sectors in which the visual apparatus is not sufficiently accurate as to perceive defects and being thus consequently disturbed.

Figure 1:
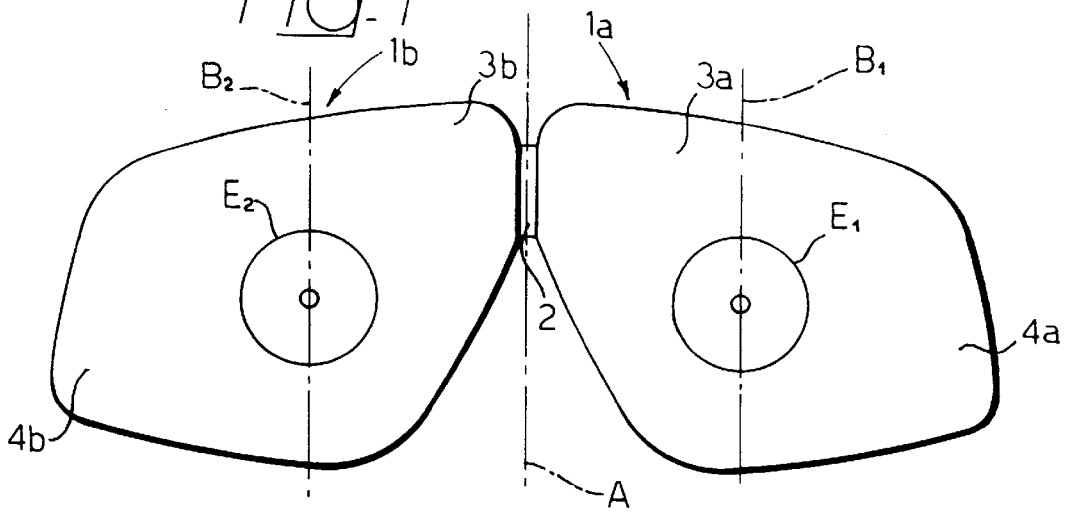
FIG. 1 is a diagrammatic front elevational view showing in a simplified way the essential construction of a pair of swimming or diving goggles according to the invention, for a general illustration of the conceptual geometrical principles thereof.
Figure 2:
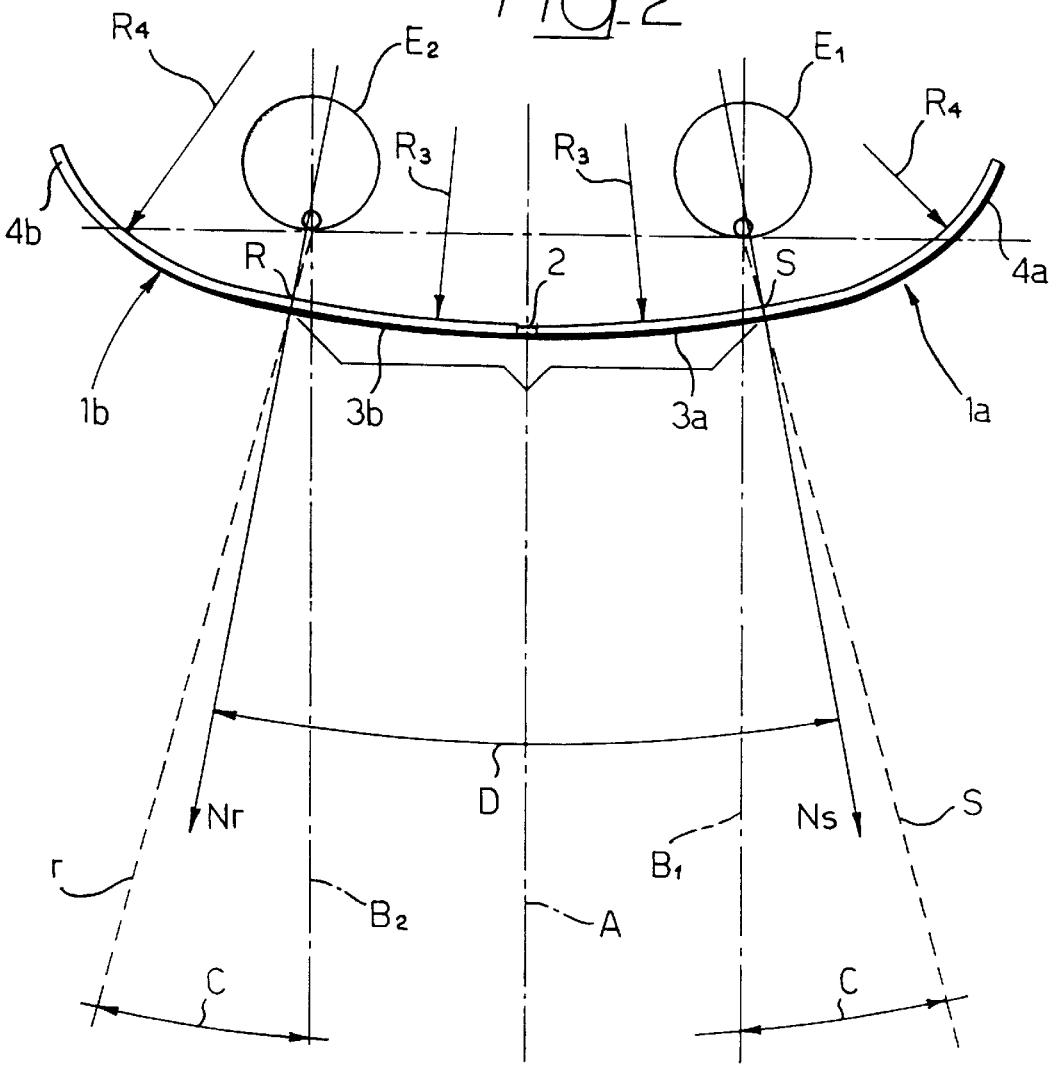
FIG. 2 is a plan view from above of FIG. 1.

This conceptual principle is explained in FIGS. 1 and 2, showing in a diagrammatic and simplified way the essential structure of the goggles according to the invention, with reference to the worn condition thereof on the face of a swimmer or diver. This structure of the goggles consists of a pair of side-by-side curved and symmetric lenses 1*a*, 1*b* mutually connected to each other by a rigid or semi-rigid support, ideally indicated as 2 in these figures (and which shall be disclosed in more detailed in the following), ensuring constancy and undeformability of the geometrical characteristics of the two lenses 1*a,* 1*b*. It is to be pointed out that the two lenses 1*a,* 1*b,* may be integrally formed as portions of a single transparent sheet. In case this single sheet is also self-supporting, the rigid structure 2 may simply include a bridge portion of this sheet, made in one piece with the portions thereof defining the lenses 1*a,* 1*b*. In alternative, and according to the preferred embodiment which shall be disclosed in the following with reference to FIGS. 3 through 6, the lenses 1*a,* 1*b* are formed by two distinct transparent sheets and the structure 2 is constituted by a supporting frame with which the two lenses 1*a,* 1*b* are sealingly assembled.

In either case the lenses 1*a,* 1*b* are in use applied in a watertight fashion against the surface of the user's face surrounding his eye E1, E2 by means of respective soft contact members, not depicted for simplicity in FIGS. 1 and 2, which ideally define with the lenses 1*a,* 1*b* a pair of eyepieces. These soft contact members, which shall be disclosed in more detail in the following, are preferably constituted by respective portions of a single annular seal having a figure eight continuous ovaloid shape so as to bear against the user's forehead, temples, checks and nasal septum. In the alternative, the soft contact members may be formed by portion of a single annular seal having a continuous oval shape, bearing not on the nose but against the upper lip of the user, so as to enclose the nose as a conventional diving mask. According to a further alternative, the soft contact members may be formed by two distinct annular seals, each surrounding a respective user's eye.

Accordingly, the term "eyepiece" such as used in the present disclosure and in the appended claims is to be intended as ideally referred, independently of the presence or absence of a support frame for the lenses 1*a,* 1*b,* to the elementary structure defined by:

each lens (either distinct and separate from the other lens, or in one piece with the other lens and, in the latter case, even if the support structure of the goggles is simply formed by the single self-supporting sheet defining the integral lenses 1*a,* 1*b*), the related seal member for watertight contact onto the surface of the user's face (formed as an integral portion of a single annular seal having either a figure eight continuous ovaloid shape or a continuous oval shape, or formed by an annular seal distinct from that of the other lens).

The fundamental feature of the assembly formed by the lenses 1*a,* 1*b* and by the support structure 2 consists of the combination between a unique progressive curvature and extreme proximity to the user's face i.e. to the eyes E1, E2, of that surface of curvature in use of the goggles.

In more detail, each lens 1*a,* 1*b* is designed according to a vertical cylindrical surface, i.e. a surface having a curvilinear generating line lying on the horizontal plane and rectilinear vertical directrixes. In other words, this surface can be assimilated to a variable radius and vertical-axes cylindroid. Any further curvature, namely in the vertical plane as in the case of the above-mentioned document DE-A-42 18 349 is specifically excluded.

The above curvature is disclosed by a peculiar geometrical law, according to which the inner front portion of each lens 1*a,* 1*b,* i.e. that shown as 3*a,* 3*b* and substantially located between a central vertical symmetry planes A of the goggles and the vertical plane B1, B2 substantially passing through the centers of the corresponding eyes E1, E2 of the user, is only slightly curved, i.e. nearly having a planar configuration, while the outer lateral portions, i.e. the ones extending beyond the vertical planes B1, B2 and designated as 4*a,* 4*b,* respectively, have a greater curvature.

According to the invention, the curvature radius of each front portions 3*a,* 3*b,* indicated as R3, is not less that 130 mm, and is. preferably of about 200 mm. The curvature radius of each lateral portion 4*a,* 4*b,* indicated as R4, is instead not less than 25 mm, and is preferably of about 35 mm. Connecting areas between the portions 3*a,* 4*a* and 3*b,* 4*b* are progressively and smoothly merging with each other, without corners or discontinuities.

In other words, the area placed in front of the center of the user's face, up to the center lines of the eyes E1, E2, or a little farther to include the portions of the two lenses 1*a,* 1*b* through which objects are seen with both eyes, has a quite large curvature radius and, as previously pointed out, is nearly planar, which prevents image doubling. If an object can be seen by both eyes E1, E2, the related signal to the right eye E2 is almost same as the signal to the left eye E1. Departing from the central area towards the right and left ends of the assembly formed by the lenses 1*a,* 1*b,* the curvature radius decreases, in a progressive fashion, to greatly widen the visual field to the right and to the left, up to a coverage of about 180°. Moreover any risks of doubling images is prevented, since vision through these extreme areas is performed by one single eye. On the other hand any out-of-focus defects, due to the relevant cylindrical dioptric surface, are barely detected since seen by the outer lateral peripheral areas of the eyes, which are very little sensitive to optical defects and instead more adapted to reveal the presence of an object or its motion, rather than to notice the details thereof. Additionally the absence of any discontinuities, i.e. the smoothly and progressively merging surfaces of the two lenses 1*a,* 1*b,* with progressively decreasing curvature radiuses, enable making the transition to areas having more important out-of-focus defects practically not perceptible.

It is to be pointed out that a perfectly planar configuration of the front portion 3*a,* 3*b* of the lenses 1*a,* 1*b* should be avoided, since homogeneously perfect vision over a too wide sector might instead give a non homogeneity impression if compared with the lateral slightly imperfected vision. In other words, motion of an object might appear discontinuous, and accordingly an even slightly cylindrical conformation of these central portions 3*a,* 3*b* is to be considered as preferred.

As previously set forth, this progressive curvature arrangement is combined, according to the invention, with an extreme proximity between the curvature surface of the lenses 1*a,* 1*b* and the user's eyes E1, E2. This proximity can be geometrically defined, precising that the two visual rays r and s, lying on the horizontal plane, coming out from the two eyes E2, E1, respectively, and diverging by a same angle C of 15° with respect to the corresponding vertical plane B2, B1, must hit the inner surface of the lenses 1*b,* 1*a* at two points R and S such that the perpendiculars NR and NS to the surface at these two points are diverging from each other by an angle D not greater than 30°. This angle D can be for instance of about 21°.

The conceptual principles of the invention such as disclosed in the above with reference to FIGS. 1 and 2 can be put into practice according to the preferred embodiment of the invention shown in FIGS. 3 through 6, to which reference will be made in the following.

In these figures the curved lenses 1*a,* 1*b* are actually constituted by two different and symmetrical thin sheets (1–2 mm), preferably made of transparent, possibly coloured, organic material (CR 39, polycabornate, cellulose acetate or propionate, etc), also possibly treated by anti-tarnishing methods on the inner surface and/or by anti-scratching and/or mirroring and/or photoabsorbing methods or the like either on the outer surface or within the mass thereof.

The rigid or semi-rigid connecting structure 2 between the lenses 1*a,* 1*b* is formed by a frame normally made in one piece of moulded plastic material with a relatively thin construction and a curvilinear configuration precisely corresponding to that of the two lenses 1*a,* 1*b*. In the case of the shown example, the frame 2 defines a lower central recess 5, made convex so as to avoid contact with the user's nose and connected to the frame upper side 6 through a vertical bridge 7, which ideally subdivides the goggles into two eyepieces 8*a,* 8*b,* which are thus connected to each other substantially rigidly, and anyhow firmly.

In this case therefore each eyepiece 8*a,* 8*b* comprises in practice a respective annular portion 2*a,* 2*b* of the frame 2 within which the corresponding lens 1*a,* 1*b* is sealingly fitted in the way which shall be clarified herebelow.

At the inner side of the goggles, each eyepiece 8*a,* 8*b* is completed by a respective soft contact member 9*a,* 9*b* into which an inner continuous seal 9 is ideally subdivided, which in use is to be applied in a watertight fashion against the surface of the user's face. The seal 9, having a generally curvilinear configuration corresponding to that of the lenses 1*a,* 1*b,* is formed as figure eight continuous ovaloid so as to bear against the forehead, the temples, the cheeks and the nasal septum of the user, thus enclosing his eyes E1, E2. The seal 9 may be made of elastomeric material (rubber, silicone, PVC, etc.), or of foamed material, as stated in one continuous piece.

It is however to be pointed out that the construction of the frame 2 as well as that of the seal 9 might be different from that shown in the drawings, for instance so as to bear inferiorly not on the nose but on the upper lip of the user, thus enclosing the nose as a conventional diving mask. In this case the seal 9, also made in one continuous piece, would have a substantially oval general design. According to a further alternative embodiment, the contact members 9*a,* 9*b* into which the seal 9 is ideally subdivided might be constituted by two closed rings, separated from each other or mutually connected in correspondence of the vertical bridge 7 of the frame 2.

It is further to be pointed out, as already clarified in the above, that the two eyepieces 8*a,* 8*b* might simply be defined by the two lenses 1*a,* 1*b* together with the related seal portions 9*a,* 9*b,* thus suppressing the frame 2. In this case the lenses 1*a,* 1*b* would be simply connected to each other in a substantially rigid fashion in correspondence of the center line of the goggles, namely would consist of integral portions of a single self-supporting transparent sheet. According to this construction, the portions 9*a,* 9*b* of the seal 9 would be directly secured in a watertight manner to the inner faces of the lenses 1*a,* 1*b,* by conventional methods such as bonding and the like.

In the case of the shown example, a unique assembling system between the lenses 1*a,* 1*b,* the seal 9 and the frame 2 is provided, employing a pair of hollow closure members 10 arranged at the opposite ends of the frame 2, flush therewith and forming extensions of the curvature thereof, and also providing two buckles for the anchoring and adjustment of an elastic strap 11 intended for retention of the goggles around the user's head.

Figure 5:
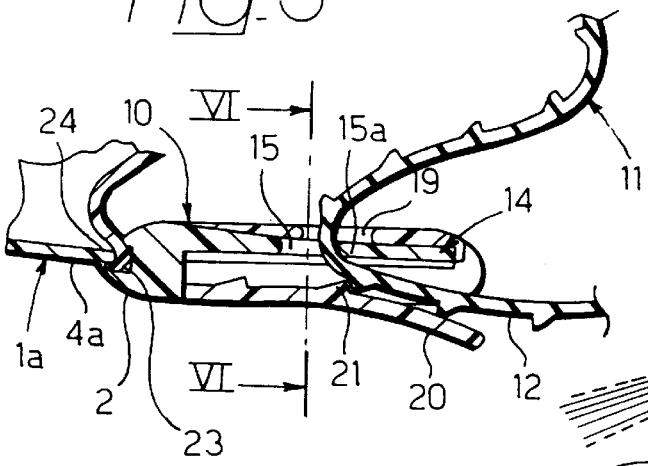
FIG. 5 is a horizontally sectioned and enlarged view along line V—V of FIG. 3.
Figure 14:
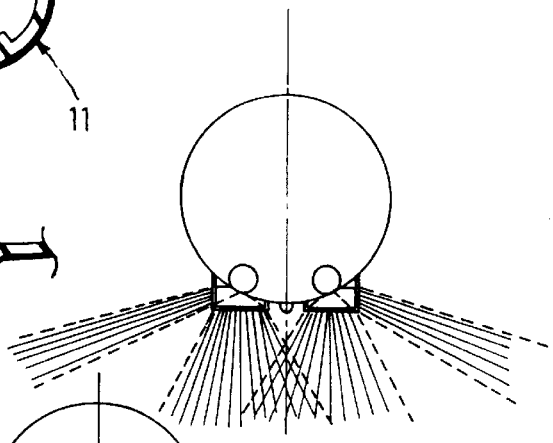
Figure 9:
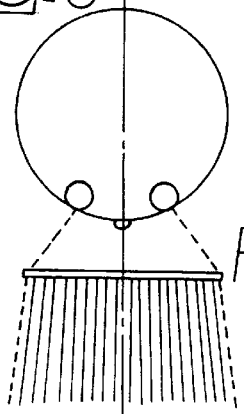
Figure 12:
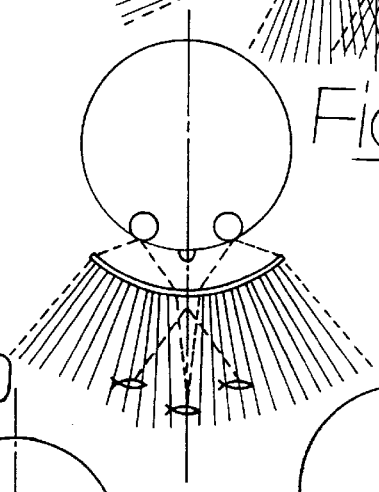
Figure 10:
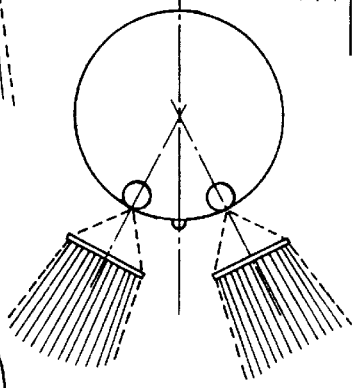
Figure 13:
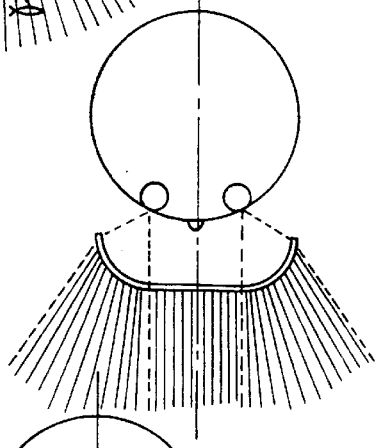
Figure 11:
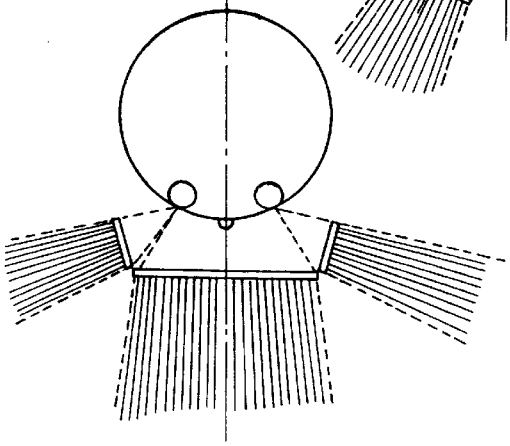
Figure 15:
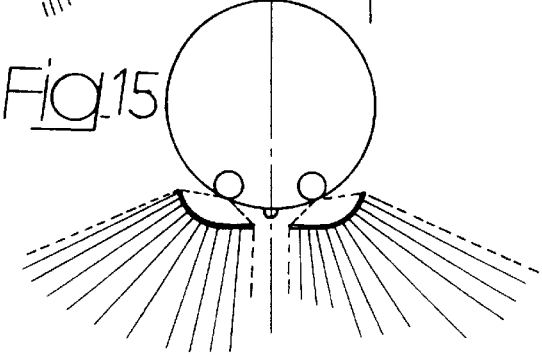

The strap 11, normally made of elastomeric material and preferably formed in its central portion with a widening areo or by two or more distinct strips so as to better wrap the back of the user's head, is provided at its ends with vertical indentations 12, preferably designed as saw teeth. Referring in detail to FIGS. 4 through 6, each annular portion 2*a,* 2*b* of the frame 2 is open at 13, i.e. at the respective end opposite to the central bridge 7. In correspondence of the opening 13, each annular portion 2*a,* 2*b* is integrally formed with an upper terminal lowered plate 14 and with a lower terminal lowered plate 16. At the edges of the opening 13, the plates 14 and 16 are formed with respective planar bearing flanges 17, 18. Moreover each upper plate 14 has a respective slot 15 whose rear edge defines a deviating member 15*a*.

Each hollow closure member 10 is normally formed with one piece of moulded plastic material, with a general shape complementary to that of a respective pair of plates 14 and 16. The hollow closure member 10 has on its rear wall an aperture 19, and on its front wall a resiliently deformable integral wing 20 on the inner surface of which a catch tooth 21 is integrally formed. Beneath the resilient wing 20, the closure member 10 is innerly provided with an integral guide groove 22.

Moreover each hollow closure member 10 may be innerly formed with integral retainer members (not shown in the drawings) adapted to engage, by means of a snap fit, corresponding integral retainer elements (also not shown in the drawings) of the respective plate 14 and/or 16 of the frame 2.

Figure 7:
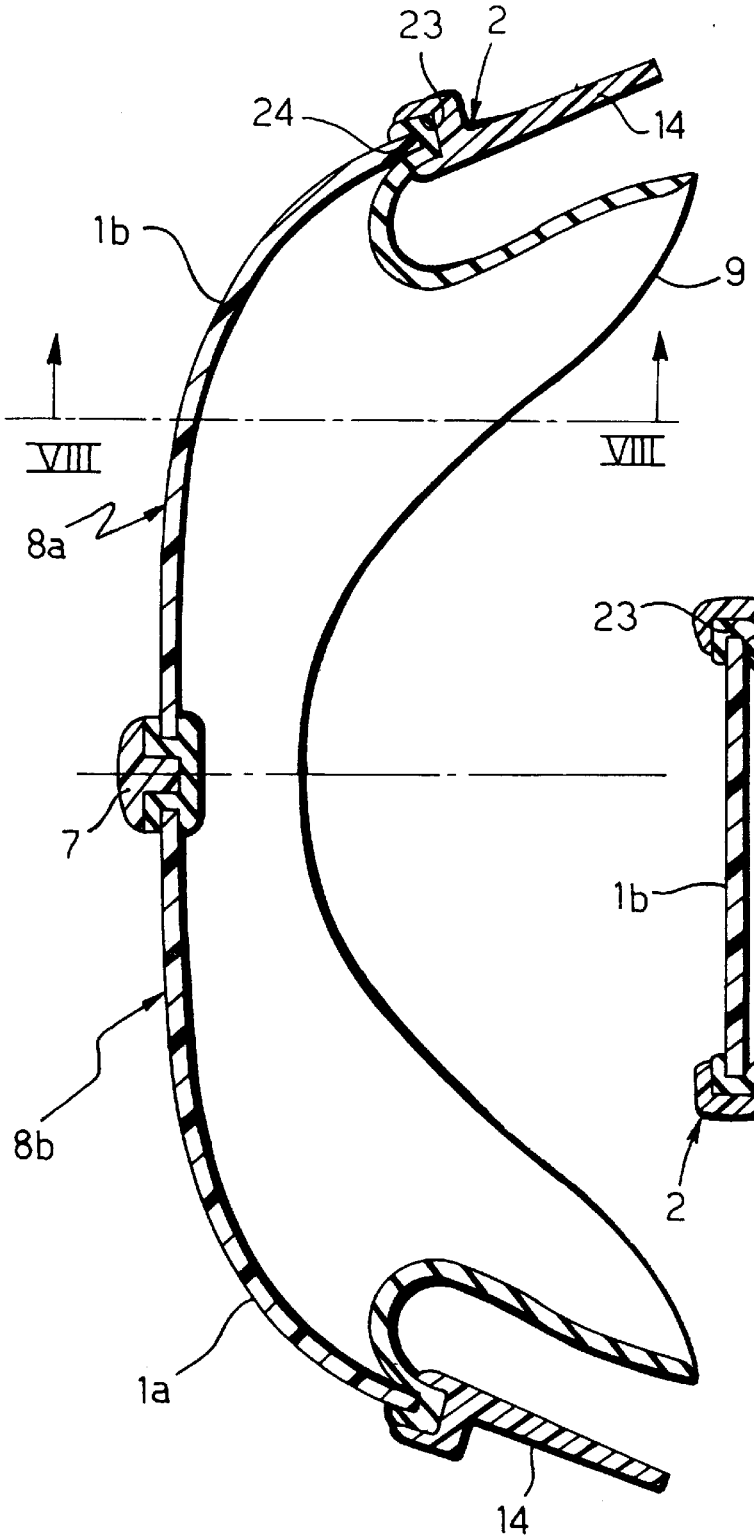
FIG. 7 is a horizontally sectioned view along VII—VII of FIG. 3.
Figure 8:
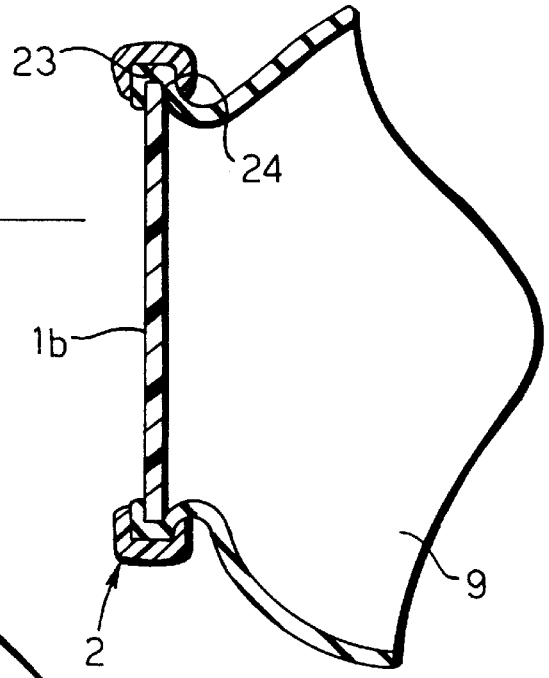
FIG. 8 is a vertical section along line VIII—VIII of FIG. 7, and FIGS. 9 through 15 are diagrammatic and horizontally sectioned top plan view showing the solutions according to the prior art as previously disclosed.

Referring in better detail to FIGS. 5, 7 and 8, the frame 2 is formed at the inner side of each annular portion 2*a,* 2*b* with a circumferential channel-like seat 23, extending also along a corresponding side of the central bridge 7, and the seal 9 is provided along the front edge of its portions 9*a,* 9*b* with corresponding annular grooves 24.

Assembling of the goggles is carried out as follows.

Firstly the two lenses 1*a,* 1*b* are fitted into the grooves 24 of the respective portions 9*a,* 9*b* of the seal 9, and the two assemblies thus formed are then fitted into the respective seats 23 of the annular portions 2*a,* 2*b* of the frame 2. To do this it is sufficient to slightly separate the plates 14 and 18 relative to each other, so as to elastically open the annular portions 2*a,* 2*b* and thus allow introduction of the lenses 1*a,* 1*b* together with the respective seal portions 9*a,* 9*b*.

The two closure members 10 are then inserted, after bringing the plate 14 and 16 near to each other so as to close the related annular portions 2*a,* 2*b*. Mounting of the closure members 10 is performed by slidably coupling the flanges 17, 18 of the plates 14, 16 into the guide grooves 22, and subsequent mutual snap engagement between the respective retainer elements.

Lastly the indented ends 12 of the strap 11 are connected to the respective closure members 10, which enables both to perform anchoring of these indented ends 12 and at the same time keeping, as a safety function, the closure members 10 secured relative to the frame 2. To do this, each indented end 12 is firstly introduced through the corresponding openings 19 and 15 and then, after slightly deflecting outwardly the related wing 20, the indented end 12 is pulled outside of the closure member 10. Accordingly withdrawal of the closure members 10 relative to the frame 2 is further prevented by the indented ends 12 themselves. In use, securing the strap 11 behind the user's head is ensured by retainment of the indented ends 12 between the respective deviating edges 15*a* on one side, and the catch teeth 21 on the other side. In case tightening of the strap 11 is to be increased, it is sufficient to manually grasp and pull rearwardly one or the other indented end 12, so as to perform temporary disengagement thereof from the respective catch tooth 21, due to elastic deformation of the related wing 20, up to the desired tightened condition. To loosen the strap 11 it is sufficient to elastically deform one or the other wing 20, pulling it manually outwardly, thus disengaging the related catch tooth 21 from the corresponding indented end 12 up to the desired loosened condition.

It will apparent from the foregoing that the frame 2, having the same curvilinear design of the lenses 1*a,* 1*b* and having a minimum encumbrance and thus providing minimum hydrodynamic drag, accomplishes the following essential tasks:

securing the lenses 1*a,* 1*b* and the seal 9 therebetween, in a mechanical resistant and watertight fashion, keeping the lenses 1*a,* 1*b* in a strictly constant mutual position relative to each other, thus preventing any risks of image doubling (and, in the case of a one-piece lens, warranting indeformability and curvature constancy thereof), anchoring of the ends 12 of the strap 11.

The advantages of the goggles according to the invention can be summarized as follows.

Vision

In use, vision of the swimmer or diver is fully panoramic, over substantially 180°. An object travelling along the visual field is seen as moving continuously from one end to the other end of the field, never disappearing (absence of blind spots), and without the virtual image thereof being subjected to sudden and baffling shiftings.

In the area of maximum visual concentration (i.e. in front, where the object is seen with both user's eyes), the image is practically not doubled. Indeed, calculations based on the geometrical optics laws would provide a very slight image doubling, which however in practice is not perceived. The explanation for this resides in that the portion of the cerebral apparatus performing vision is capable to mediate between two different pieces of information, provided that same are not too different from each other: more precisely it selects therebetween the one which is considered more credible (for instance choosing the signal provided by the more active of the two eyes), and without any trouble considers that information as a single and truthful image. It can be easily verified that the operation of image unification requires no appreciable cerebral labour up to small doubling angles; above certain angle values, intense and unnatural efforts are instead required, which can not be protracted for a long time and which may cause anyway nausea and dizziness.

Only at the lateral areas, refraction through the cylindrical dioptric surface having a greater curvature produce a slight out-of-focus and deformation effect of the image, which however in practice is very difficult to perceive since coming from the extreme lateral zones of the eye, naturally much less accurate and sensitive. This effect is widely balanced by the total freedom of the visual field and by the pleasure of watching "without blinkers".

Moreover the progressive and smooth variation of the curvature radius provides a pleasant continuity sensation in connection with image quality of an object moving along the visual field. The visual defects of the extreme sectors (out-of-focus, image deviation) gradually decreases while the object is approaching the center of the visual field. Therefore these defects become null and then gradually increase again in a "soft" manner, and thus in practice in a non perceivable way.

Stability on User's Face

The feature according to which the frame conforms, as viewed vertically, the profile of the forehead without any projection increase at the extreme lateral portions thereof, prevents that accidental collisions or impacts with the water may displace the goggles from the user's face.

Hydrodynamic Performance

The slight projection from the user's face and the absence of any protuberances contribute to drastically reduce the hydrodynamic drag of the goggles.

Safety

The fact that the goggles are not employing glass lenses (as known brittle), along with and the extreme compactness on the user's face make the goggles absolutely safe and unbreakable.

Lightness

The noticeable thin structure (approximatively the frame 2 can be only about six millimeters thick, whilst twelve millimeters are usually necessary for goggles or masks with planar lenses, and also the seal 9 has a reduced thickness and thus a light weight) and the use of organic lenses, limit the weight of the goggles according to the invention to about 70 grams as compared with an average of about 110 grams of conventional goggles, with consequent additional advantages in terms of comfort and stability on the user's face.

Watertightness and Comfort

The defect of conventional goggles whose eyepieces are connected in a non-rigid fashion, whereby watertightness is hugely depending upon the anatomy of the user's eye-sockets which often requires exasperated strap tensioning, is prevented. Also prevented is the defect of the conventional diving masks, whose sealed contact against user's upper lip produces numbness, requires immobility and is anyhow precarious in case of moustached users.

Sealed contact between forehead, temples, cheecks and nose is much easier and conforms the higher percentage of face profiles.

Independence of Vision From Trimming

The visual performance is independent of the strap tensioning, and is permanently maintained since the center-to-center distance and inclination of the eyepieces are constant. The rigid or semi-rigid connecting structure makes the optical geometry of the goggles invariable, even with a slight strap tensioning, which further prevents visual defects and image doubling.

Strap Adjustment

Without unwearing the goggles, lengthening the working portion of the strap by releasing tensioning thereof can easily be performed by a single finger, so as to pull outwardly one or the other of the resilient wings 20. These operation is ergonomically advantageous as compared with those mask buckles in which it is instead necessary to push inwardly a strap locking member (such as for instance in already previously mentioned documents U.S. Pat. No. 4,607,398 and IT-U-167.555). The pulling action outwardly does not involve in fact any displacement of the goggles relative to the user's face and, consequently, any risks of painful contact thereof against rigid part.

To increase the strap tensioning, as already pointed out it is sufficient to pull rearwardly one or the other free end of the strap itself.

Naturally the details of construction and the embodiments may be widely varied with respect to what has been disclosed and illustrated, without thereby departing from the scope of the present invention, such as defined in the appended claims. Thus, for example, the following variants are also to be contemplated:

the shape of the contact area of the goggles against the user's face may be same as that of a conventional diving mask, i.e. also include the user's nose;

the design of the goggles contacting area on the user's face may be doubly annular, instead of mono-annular, i.e. such as to completely surround one and the other user's eyes, provided that the rigid structure (frame) keeps unchanged the correspondence between the theoretical geometrical surface and the shape and actual positioning of the two lenses;

the lenses may also be made of curved and tempered glass;

assemblying of the seal 9 with the lenses may be performed even by means of different systems, and the two open-ring 2*a,* 2*b* configuration of the frame 2 may employ, for closure thereof, different systems from the buckles disclosed in the above: for instance, these systems may include screws, snap-fit elements, restrained joint members, etc. Moreover it is not to be excluded, as in several diving mask, a locking system between lenses and frame including one or two auxiliary inner resilient rings, intended to axially press the lens against the seal;

the seal may be made of foamed material, such as formed neoprene or polyurethane;

the self supporting structure (frame) instead of rigid may be semi-rigid or slightly flexible; in this case constancy of the mutual geometric position between the two lenses may be warranted by co-operation between this semi-rigid structure and bearing of the goggles against the user's forehead, which may practically afford a sufficient structural stability of the entire goggles;

the strap buckles disclosed in the above may be either less sophisticated (for instance made of simple slots through which the strap is passed through and anchored), or more sophisticated (for instance including rotary devices, pivoted links or rollers to facilitate strap sliding, etc.);

the frame may be simplified or even suppressed, and accordingly—as already pointed out—the supporting structure shall be constituted by the lenses themselves having a self-supporting capacity, with the seal simply bonded to the inner face of the lenses.

What is claimed is:

1. Swimming or diving goggles including:

a pair of side-by-side symmetrical lenses, contact means sealingly connected to said lenses and in use to be applied in a watertight fashion onto the face surface surrounding the eyes of a user;

connecting means between said lenses, retainer means of the goggles behind the user's head, wherein each lens has, with reference to a respective user's eye, a front portion and an outer lateral curved portion smoothly merging with each other without corners, and wherein:

each lens is shaped according to a cylindrical surface having rectilinear vertical generating lines and progressively variable curvature radius, much greater in correspondance of said front portion and smaller in correspondance of said lateral portion, said connecting means are substantially rigid and substantially shaped and arranged according to the same cylindrical surfaces of the respective lenses, said contact means are secured to said lenses through said connecting means, whereby in use said lenses are placed in close proximity of the face surface surrounding the eyes of the user, and wherein, with reference to the use condition of the goggles, the distance between said two lens and the surface of the user's face is such that two visual rays coming out from the user's eyes in a horizontal plane each with a diverging angle of about 15° with respect to a vertical symmetry plane of the goggles, hit the lenses at two points thereof in which two lines perpendicular to the lenses and passing through said two points diverge from each other by an angle less than 30°.

2. Goggles according to claim 1, wherein the curvature radius of the cylindrical surface of each lens in correspondence of the respective front portion thereof is not less than 130 mm, and is about 200 mm.

3. Goggles according to claim 1, wherein the curvature radius of the cylindrical surface of each lens in correspondance of the respective lateral portion thereof is not less than 25 mm, and is about 35 mm.

4. Goggles according to claim 1, wherein said connecting means comprise a rigid supporting frame having two annular portions defining in one piece two eyepieces.

5. Goggles according to claim 4, comprising a continuous annular seal member made of a soft material and connected in a watertight fashion to said annular portions of said supporting frame, and wherein said contact means are defined by integral portions of said continuous annular seal member.

6. Goggles according to claim 5, wherein said supporting frame has, in correspondence of each of said two eyepieces, a respective substantially channel-like annular seat, said seal member defines, in one piece with said contact elements, a pair of substantially channel-like annular seals housed within said annular seats of said frame, and said two lenses are peripherally fitted within said annular seals.

7. Goggles according to claim 4, wherein:

said supporting frame has opposite open ends, a pair of hollow closure members is releasably engaged on said open ends of said supporting frame and form therewith respective anchoring buckles, said retainer means comprise a flexible strap having saw-tooth indented ends adjustably engaged through said anchoring buckles.

8. Goggles according to claim 7, wherein said indented ends of said strap, when engaged through said buckles, act as safety members preventing disengagement of said closure members relative to said supporting frame.

9. Goggles according to claim 8, wherein each of said buckles comprises an outer aperture and an inner aperture formed at corresponding positions respectively in the hollow closure member and in the corresponding open end of said supporting frame, a deviating member formed on said open end, and a catch member facing towards said deviating member for engagement of the respective indented end of said strap and to which a resiliently deformable wing is fixed, said wing projecting laterally from said closure member and being adapted to be manually pulled outwardly of the goggles so as to release said indented end of said strap.

10. Goggles according to claim 1, wherein each of said lenses is formed by a thin sheet of transparent organic material.

11. Goggles according to claim 1, wherein each of said lenses is treated by anti-tarnishing methods on the inner surface thereof.

12. Goggles according to claim 1, wherein each of said lenses is treated by anti-scratch and/or mirroring and/or photoabsorbing methods on the outer surface or within the mass thereof.

13. Goggles according to claim 4, wherein said two lenses are defined by integral portions of a single sheet.

14. Goggles according to claim 13, wherein said sheet is self-supporting, whereby said two eyepieces are solely formed by said portions of said sheet defining said two lenses and by the respective contact means.

15. Goggles according to claim 5, wherein said annular seal member has a continuous figure eight ovaloid shape so as to bear against forehead, temples, cheeks and nasal septum of the user.

16. Goggles according to claim 5, wherein said annular seal member is formed by two distinct annular seals, each surrounding a respective user's eye.

* * * * *